US007682780B2

(12) United States Patent
Fujita et al.

(10) Patent No.: US 7,682,780 B2
(45) Date of Patent: Mar. 23, 2010

(54) INDUSTRIAL X-RAY PHOTOSENSITIVE MATERIAL

(75) Inventors: Masayoshi Fujita, Shizuoka-ken (JP); Yoshihisa Hashi, Shizuoka-ken (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 12/486,770

(22) Filed: Jun. 18, 2009

(65) Prior Publication Data

US 2010/0009300 A1 Jan. 14, 2010

(30) Foreign Application Priority Data

Jul. 8, 2008 (JP) ..... 2008-178258

(51) Int. Cl.
*G03C 1/005* (2006.01)
*G03C 1/494* (2006.01)
*G03C 1/00* (2006.01)

(52) U.S. Cl. ..... 430/567; 430/966; 430/604; 430/605; 430/617; 430/618; 430/619; 430/620

(58) Field of Classification Search ..... 430/966, 430/604–605, 567, 617–620
See application file for complete search history.

(56) References Cited

U.S. PATENT DOCUMENTS 7,393,626 B2 * 7/2008 Yamamoto ..... 430/619

FOREIGN PATENT DOCUMENTS

JP 9-106018 A 4/1997

* cited by examiner

*Primary Examiner*—Geraldina Visconti
(74) *Attorney, Agent, or Firm*—Solaris Intellectual Property Group, PLLC

(57) ABSTRACT

An industrial X-ray photosensitive material including at least one silver halide emulsion layer on both sides of a transparent support, wherein the silver halide emulsion layer contains tabular silver halide particles having an average particle thickness of less than 0.2 μm and an aspect ratio of more than 8, a core of the particles which is a core having a volume of 1% or more and less than 3% of a particle volume does not contain Ir or Rh, and a shell of the particles which is a shell having a volume of 97% or more and less than 99% of a particle volume contains at least Ir or Rh. An industrial X-ray photosensitive material having rapid processing suitability, as well as high sensitivity and high contrast is provided.

10 Claims, No Drawings

INDUSTRIAL X-RAY PHOTOSENSITIVE MATERIAL

CROSS-REFERENCE TO RELATED APPLICATION

This application claims priority under 35 USC 119 from Japanese Patent Application No. 2008-178258, filed on Jul. 8, 2008, the disclosure of which is incorporated by reference herein.

BACKGROUND OF THE INVENTION

1. Field of the Invention

The present invention relates to an industrial X-ray photosensitive material and, particularly, relates to an industrial X-ray photosensitive material having high sensitivity and high contrast.

2. Description of the Related Art

Industrial X-ray photosensitive materials are used for irradiating a subject with X-rays, and detecting an intensity of transmitted X-rays, in order to inspect an interior or detect a defect on a surface of an industrial member. In this field, in addition to X-rays, γ-rays from a radioactive isotope, or high energy rays or particle rays from a particle accelerator are used as a radiation ray source for recording. In addition, in recording with a photosensitive material, lamination of a thin metal foil such as a lead foil and the photosensitive material and irradiation of the radiation rays is frequently conducted. In this case, the metal foil subjected to irradiation with the radiation rays and a coated silver halide particle itself absorb the irradiation energy, and release a secondary electron beam or the like, which is finally used to expose the photosensitive material. Therefore, all of these are image recording by irradiation with radiation rays other than light. A latent image formed by irradiation with radiation is developed with a developer to form a blackened silver image. The industrial X-ray photosensitive materials are designed to detect small defects of an industrial member, and an extremely high contrast is required in order to detect the small defects. In order to attain high contrast, it has been a conventional means in industrial X-ray photosensitive materials to increase an amount of coated silver, and soften coated layers in film design. For this reason, an industrial X-ray photosensitive material product having a large amount of coated silver has problems in that a cost is determined by the cost of silver, and in that, because of having a large amount of coated silver and softened layers, a processing time becomes long, which results in a low efficiency in a detection operation and the like. Therefore, according to the conventional technology, it has been difficult to reduce the amount of coated silver, realize both high sensitivity and high contrast, and further provide rapid processing suitability.

The use of a tabular silver halide particle is known as a means for enhancing a sensitivity of silver halide. For example, Japanese Patent Application Laid Open (JP-A) No. 9-106018 discloses that an industrial X-ray photosensitive material using a tabular silver halide particle having an average aspect ratio of 2 or more with respect to 50% or more of a total particle projection area has a higher photographic sensitivity to radiation rays as compared with a photographic sensitivity to radiation rays obtained by using a non-tabular silver halide particle having the same particle volume, and gives high sensitivity without increasing an amount of silver.

SUMMARY OF THE INVENTION

The present invention has been made in view of the above circumstances and provides an industrial X-ray photosensitive material with the following aspect.

An aspect of the invention provides an industrial X-ray photosensitive material comprising at least one silver halide emulsion layer on both sides of a transparent support, wherein the silver halide emulsion layer contains tabular silver halide particles having an average particle thickness of less than 0.2 μm and an aspect ratio of more than 8, a core of the particles which is a core having a volume of 1% or more and less than 3% of a particle volume does not contain Ir or Rh, and a shell of the particles which is a shell having a volume of 97% or more and less than 99% of a particle volume contains at least Ir or Rh.

DETAILED DESCRIPTION OF THE INVENTION

An object of the present invention is to provide an industrial X-ray photosensitive material having high sensitivity and high contrast. Particularly, an object of the invention is to provide an industrial X-ray photosensitive material having rapid processing suitability, as well as high sensitivity and high contrast.

The problems of the invention described above have been solved by an industrial X-ray photosensitive material including at least one silver halide emulsion layer on both sides of a transparent support, wherein the silver halide emulsion layer contains tabular silver halide particles having an average particle thickness of less than 0.2 μm and an aspect ratio of more than 8, a core of the particles which is a core having a volume of 1% or more and less than 3% of a particle volume does not contain Ir or Rh, and a shell of the particles which is a shell having a volume of 97% or more and less than 99% of a particle volume contains at least Ir or Rh.

Preferably, the shell of the particles contains Ir or Rh in an amount of from $1\times10^{-9}$ mol % to $1\times10^{-2}$ mol % per 1 mole of silver.

Preferably, a water swelling value per one side of the industrial X-ray photosensitive material is less than 20 μm.

Preferably, an amount of coated silver per one side of the industrial X-ray photosensitive material is less than 5.5 g/m$^2$.

Preferably, a ratio by weight of a total amount of coated gelatin to an amount of coated silver per one side of the industrial X-ray photosensitive material (total amount of coated gelatin/amount of coated silver) is from 1.4 to 1.8.

Means for preparing silver halide particles having a high aspect ratio have been studied extensively in order to enhance photographic sensitivity. With these means, it has become possible to prepare tabular particles having a high aspect ratio relatively easily.

However, although silver halide particles having a high aspect ratio can give high sensitivity, there are various problems in application thereof to industrial X-ray photosensitive materials.

First, with silver halide particles having a high aspect ratio, it is difficult to obtain high contrast required for industrial X-ray photosensitive materials. Secondly, as the aspect ratio becomes higher, pressure sensitization and scratch resistance are extremely deteriorated, and therefore, it is unsuitable to use such silver halide particles for a defect detecting means like an industrial X-ray photosensitive material. JP-A No. 9-106018 discloses an industrial X-ray photosensitive material using silver halide tabular particles having an aspect ratio of from 5 to 25, but does not disclose or suggest such technical problems or means for solving the same at all.

According to the present invention, an industrial X-ray photosensitive material having high sensitivity and high contrast may be provided. Particularly, an industrial X-ray photosensitive material which has high sensitivity and high contrast, and also has a sufficient image density with a small amount of coated sliver may be provided. Further, according to the invention, an industrial X-ray photosensitive material which gives an image of high sensitivity and high contrast under various exposing conditions (direct exposure by X-rays, a secondary electron beam from a Pb foil, light emission from a fluorescent screen, or gamma rays from a radioactive isotope such as Co) may be provided.

Furthermore, according to the invention, since softening of coated layers is not required, a swelling value of the layers may be designed to be low, and a coated amount of silver may be reduced, rapid development processing taking less than 3 minutes and 30 seconds, which was impossible previously, may be performed. Thereby, an image having no processing irregularity and excellent in a surface uniformity may be provided, and a developing processing step is improved in that, for example, an amount of a replenisher may be reduced by half.

The present invention will be explained in more detail below.

1. Industrial X-Ray Photosensitive Material

The industrial X-ray photosensitive material of the invention has at least one silver halide emulsion layer on both sides of a transparent support, wherein the silver halide emulsion layer contains tabular silver halide particles having an average thickness of less than 0.2 μm and an aspect ratio of more than 8, where a core of the particles (a core of particles, which is a core part corresponding to 1% or more and less than 3% of a particle volume) do not contain Ir or Rh, and a shell of the particles (a shell of particles, which is a shell part corresponding to 97% or more and less than 99% of a particle volume) contains at least Ir or Rh.

A content of Ir or Rh in the shell of the particles is preferably from $1\times10^{-9}$ mol % to $1\times10^{-2}$ mol %, more preferably from $1\times10^{-8}$ mol % to $1\times10^{-3}$ mol %, and even more preferably from $1\times10^{-7}$ mol % to $1\times10^{-4}$ mol % per 1 mole of silver.

A water swelling value per one side containing the silver halide emulsion layer of the industrial X-ray photosensitive material is preferably less than 20 μm, more preferably 5 μm or more and less than 20 μm, and even more preferably from 8 μm to 15 μm.

An amount of coated silver per one side of the industrial X-ray photosensitive material is preferably less than 5.5 g/m$^2$, more preferably 3.0 g/m$^2$ or more and less than 5.5 g/m$^2$, and even more preferably from 4.0 g/m$^2$ to 5.0 g/m$^2$.

A ratio by weight of a total amount of coated gelatin to an amount of coated silver (total amount of coated gelatin/amount of coated silver) per one side of the industrial X-ray photosensitive material is preferably from 1.40 to 1.80, more preferably from 1.50 to 1.75, and even more preferably from 1.55 to 1.70.

The inventors aimed to develop an industrial X-ray photosensitive material using tabular silver halide particles having a high aspect ratio of more than 8. In the investigation, it was found out that a great technical problem is to enhance contrast, to reduce defects such as those caused by pressure sensitization, and to improve scratch resistance or the like. Therefore, the inventors intensively conducted to solve the problems.

As a result, it has been found that the problems are solved by means described above, whereby the present invention was achieved.

The effect of the tabular silver halide particles of the invention is that unexpectedly high gradation is obtained, and thereby, high contrast preferable for an industrial X-ray photosensitive material is obtained.

The contrast (gradation) in the present invention is defined as follows.

Representing the radiation energy necessary for obtaining a density of (fog+transmission optical density of 1.5) as $E_0$, and the radiation energy $E_1$ necessary for obtaining a density of (fog+transmission optical density of 3.5) as $E_1$, gradation $(G)=(3.5-1.5)/(\log E_1-\log E_0)$.

The gradation (G) preferable for the industrial X-ray photosensitive material of the present invention is 4.0 or more. More preferable, the gradation is 4.5 or more.

<Layer Construction>

The industrial X-ray photosensitive material of the invention preferably has a non-photosensitive hydrophilic colloid layer such as a protective layer or the like, in addition to the silver halide emulsion layer, on both sides of the industrial X-ray photosensitive material.

According to the present invention, since sufficient image density may be obtained at a small amount of coated sliver, an amount of coated silver of the silver halide emulsion layer may be reduced and further, a total amount of coated gelatin including gelatin in the sliver halide emulsion layer and the non-photosensitive hydrophilic colloid layer may be reduced, and a thinner layer construction may be attained. The coated amount of silver is preferably from 3.0 g/m$^2$ to 5.5 g/m$^2$, more preferably from 4.0 g/m$^2$ to 5.0 g/m$^2$ per one side.

The total amount of the coated gelatin in the invention is 10 g/cm$^2$ or less, preferably from 5.5 g/m$^2$ to 9.0 g/m$^2$, and more preferably from 6.0 g/m$^2$ to 8.0 g/m$^2$ per one side. In this case, an amount of coated gelatin in the protective layer is preferably from 1.0 g/m$^2$ to 2.0 g/m$^2$.

<Swelling Value of Coated Layer>

In the present invention, a swelling value (water swelling value) of the photosensitive material is defined and determined as a value obtained by subtracting a film thickness value in the dry state from a film thickness value after immersion of the photosensitive material in distilled water for 3 minutes at 21° C. The swelling value of the photosensitive material in the present invention is preferably less than 20 μm, more preferably 5 μm or more and less than 20 μm, and even more preferably from 8 μm to 15 μm from the viewpoint of rapid processing performance.

2. Photosensitive Silver Halide Emulsion

The silver halide emulsion used in the invention is to be explained.

1) Halogen Composition

The sliver halide particles contained in the silver halide emulsion layer of the present invention may have any silver halide composition such as silver chloride, silver bromochloride, silver iodochloride, silver iodobromochloride, silver bromide, silver iodobromide or the like. In view of that high sensitivity is obtained, silver bromide or sliver iodobromide is preferable.

A content of silver iodide is preferably 2 mol % or less, and particularly preferably from 0.05 mol % to 0.45 mol %, based on an amount of silver contained in the silver halide emulsion particles from the viewpoint of rapid processing suitability.

2) Particle Shape

The aspect ratio of the silver halide particles in the present invention is defined as a value obtained by dividing an equivalent circular diameter of a projected area of one particle by a thickness of the particle.

The tabular silver halide particles in the present invention have an average particle thickness of less than 0.2 μm, and are high aspect particles having an average aspect ratio of more than 8. Preferably, the average particle thickness is from 0.03 μm to 0.15 μm, and the average aspect ratio is from 9 to 16.

The silver halide particles in the present invention may be a two-fold twinned crystal particles having two parallel twin planes. Further, the particles may be a tabular particles having a {111} plane as a main plane, or tabular particles having a {100} plane as a main plane.

3) Heavy Metal Dope

The silver halide particles in the present invention do not contain Ir or Rh in a core of the particles (core of particles, which is a core part corresponding to 1% or more and less than 3% of a particle volume), and contain at least Ir or Rh in a shell of the particles (shell of particles, which is a shell part corresponding to 97% or more and less than 99% of a particle volume). The content of Ir or Rh in the shell of a particle is preferably from $1\times10^{-9}$ mol % to $1\times10^{-2}$ mol %, more preferably from $1\times10^{-8}$ mol % to $1\times10^{-3}$ mol %, and even more preferably from $1\times10^{-7}$ mol % to $1\times10^{-4}$ mol % per 1 mole of silver.

In the case where the content of Ir or Rh in the shell of the particles is less than $1\times10^{-9}$ mol %, the high contrast effect of the present invention is not obtained, and in the case where the content is more than $1\times10^{-2}$ mol %, high sensitivity is not obtained, which is not preferable.

In the present invention, the shell of the particles may contain a mixture of Ir and Rh. In this case, the content of Ir and Rh is preferably set in a range so that a total content of Ir and Rh is in the aforementioned range.

In the present invention, the core of the particles does not contain Ir or Rh. "Does not contain" in the present invention means that the contrast is not influenced by an inclusion thereof, and an inclusion at a small amount to such an extent that the contrast is not influenced is not excluded. For example, the small amount is in a range of less than $1\times10^{-9}$ mol % based on silver.

The distribution of Ir or Rh in the particles in the present invention may be measured by a method such as a time-of-flight secondary ion mass spectroscopy (TOF-SIMS), and an etching X-ray photoelectron spectroscopy (XPS/ESCA).

Further, the silver halide emulsion particles in the present invention may be doped by a heavy metal other than Ir and Rh, which is added in a grain formation process or in a physical ripening process of the sliver halide emulsion. For example, a cadmium salt, a zinc salt, a lead salt, a thallium salt, an iron salt, a complex salt thereof or the like may be present together.

4) Production Method

As a method of producing tabular silver halide particles, methods known in the art may be conveniently combined and used.

Further, tabular particles having parallel twin planes, and having a {111} plane as a main plane may be easily prepared by referring to the method described in JP-A Nos. 58-127927, 58-113927, and 58-113928.

Alternatively, the particles may be also obtained by forming a seed crystal in which tabular particles are present at 40% by weight or more, in an atmosphere of a relatively low pBr value of 1.3 or less, and growing the seed crystal while the pBr value is kept at the same extent of the pBr value, and a silver solution and a halogen solution are added simultaneously.

In this particle growing process, it is desirable to add the silver solution and the halogen solution so that a new crystal nucleus is not generated.

The size of the tabular silver halide particles may be adjusted by regulating a temperature, selecting a solvent or an amount thereof, or controlling an addition amount and an addition speed of a silver salt and a halide used in growing the particle, or the like.

Furthermore, among the tabular silver halide particles, monodispersed hexagonal tabular particles are particularly useful particles in the present invention.

Details of the structure and the production method of the monodispersed hexagonal tabular particles are described in JP-A No. 63-151618.

The silver halide emulsion in the present invention may have a uniform crystal structure, may be different in a halogen composition between inner part and outer part of the particles, or may form a laminate structure. Further, a reduction sensitization silver nucleus is preferably contained in grain formation.

In the invention, so-called halogen conversion-type particles described in British Patent No. 635841, and U.S. Pat. No. 3,622,318 may be particularly effectively utilized. An amount of the halogen conversion is preferably from 0.05 mol % to 0.45 mol %, and particularly preferably from 0.1 mol % to 0.3 mol % based on sliver amount.

In the silver iodobromide emulsion, particles having a structure containing a high iodine layer in at least one of the inner part or the surface part thereof are particularly preferable.

In addition, by conversion of the surface of tabular silver halide particles of the invention into a high iodine type, a silver halide emulsion having higher sensitivity may be obtained.

Upon conducting a halogen conversion by the aforementioned method, a conversion in the presence of a sliver halide solvent is particularly effective. Specific examples of the solvent preferably include thioether compounds, thiocyanate salts, and tetra-substituted thioureas. Among these, thioether compounds and thiocyanate salts are particularly effective. The thiocyanate salts are preferably used in a range of from 0.5 g to 5 g, and the thioether compounds are preferably used in a range of from 0.2 g to 3 g per 1 mole of silver halide.

As the method of growing silver halide particles of the invention, any method which has previously been known may be used. That is, an aqueous silver salt solution and an aqueous halogen salt solution are added into a reaction container under an effective stirring. Specific method includes preparing by the method described in P. Glafkides, Chimie et Physique Photographique (published by Paul Montel, 1967), G. F. Duffin, Photographic Emulsion Chemistry (published by The Focal Press, 1966), and V. L. Zelikman et al., Making and Coating Photographic Emulsion (published by The Focal Press, 1964). That is, the method may be any of an acidic method, a neutral method, an ammonium method or the like, and as a manner of reacting a soluble silver salt and a soluble halogen salt, any of a one side mixing method, a simultaneous mixing method, or a combination thereof may be used.

As one embodiment of the simultaneous mixing method, a method in which the pAg in a liquid phase in which silver halide is formed is kept constant, that is, a so-called controlled double jet method may be used.

Furthermore, it is also preferable to grow particles rapidly in a range not exceeding a critical supersaturation degree, by a method in which an addition speed of a silver nitrate solution or an aqueous alkali halide solution is varied depending on the particle growing speed, as described in each of British Patent No. 1535016, and Japanese Patent Application Publication (JP-B) No. 48-36890, and JP-B No. 52-16364, or by a method in which the aqueous solutions are varied in their concentration, as described in U.S. Pat. No. 4,242,445, and JP-A No. 55-158124.

Crystal growth of tabular particles by physical ripening (fine particles are dissolved, and substrate particles are grown) in the presence of silver halide fine particles is also preferably performed.

In the fine particle emulsion addition method, an AgX (X represents a halogen ion) fine particle emulsion including fine particles having a diameter of 0.15 μm or less, preferably 0.1 μm or less, more preferably 0.06 μm to 0.006 μm is added, and tabular particles are grown by Ostwald ripening. The fine particle emulsion may be added sequentially or may be added continuously. The fine particle emulsion may be sequentially prepared in a mixing vessel provided in vicinity of a reaction container by supplying an $AgNO_3$ solution and an $X^-$ salt (halogen salt) solution to the mixing vessel, and sequentially added to the reaction container. The fine particle emulsion may also be prepared previously in another container in a batch manner, and thereafter, may be sequentially or continuously added.

The fine particle emulsion may be added in a liquid state, or may be added as a dry powder. Alternatively, the dry powder is mixed with water immediately before addition, and is converted into a liquid, which may be added. The fine particles are added in such a manner that the particles are lost preferably within 20 minutes, more preferably from 10 seconds to 10 minutes. In the case where the losing time becomes longer, ripening occurs between fine particles to result in increase in particle size, which is not preferable. Therefore, it is preferable not to add the total amount at once. It is preferable that the fine particles substantially do not contain multi-fold twin crystal particles. Herein, the multi-fold twin crystal particles refer to particles having 2 or more twin crystal planes per one particle. "Substantially do not contain" refers to the multi-fold twin crystal particles in which a ratio of multi-fold twin crystal particles having twin crystal plane is 5% or less, preferably 1% or less, and more preferably 0.1% or less. It is further preferable that one-fold twin crystal particles are not also contained substantially. It is even further preferable that particles having spiral dislocation are not substantially contained. Herein, "not substantially contained" is subject to the aforementioned rule.

In a nucleation step of the tabular sliver halide particles, it is extremely effective to use gelatin having a low content of methionine as described in U.S. Pat. Nos. 4,713,320 and 4,942,120, to form a nucleus at a high pBr as described in U.S. Pat. No. 4,914,014, and to form a nucleus in a short time as described in JP-A No. 2-222940. Particularly, gelatin having a methionine content of from 0 μmol/g to 50 μmol/g is particularly used, and more preferably from 0 μmol/g to 40 μmol/g. When such gelatin is used in a ripening step or growing step, thinner tabular particles having a uniform diameter size distribution are formed, which is preferable.

In the invention, particularly preferably, an aqueous silver nitrate solution, an aqueous halogen solution, and an oxidation-treated gelatin having a low molecular weight are added within one minute at a temperature of from 20° C. to 40° C. under stirring in the presence of an oxidation-treated gelatin having a low molecular weight. In this process, the pBr of the bulk is preferably 2 or more, and the pH thereof is preferably 7 or less. The concentration of the aqueous silver nitrate solution is preferably 0.6 mol/L or less. The molecular weight of gelatin is preferably less than normal molecular weight thereof, and particularly preferably 10000 to 50000.

A modified gelatin in which amino groups are phthalated, succinated, or trimellitated at 90% or more, or an oxidation-treated gelatin in which at least a content of methionine is reduced is particularly preferably used.

Further, the ripening step may be performed in the presence of a low concentration of a base as described in U.S. Pat. No. 5,254,453, or may be performed at a high pH as described in U.S. Pat. No. 5,013,641. Furthermore, a polyalkylene oxide compound described in U.S. Pat. Nos. 5,147,771, 5,147,772, 5,147,773, 5,171,659, 5,210,103 and 5,252,453 may be added in the ripening step or a later growing step.

In the invention, the ripening step is preferably performed at a temperature of from 60° C. to 80° C. It is preferable to lower the pBr to 2 or lower immediately after nucleus formation or during ripening. In addition, additional gelatin is preferably added within a period from immediately after nucleation to before completion of ripening. Particularly preferable gelatin is a modified gelatin in which 95% or more of amino groups is succinated or trimellitated.

The pH at grain growth by addition of fine particles is preferably 2.0 or higher, more preferably from 6 to 10, and even more preferably from 6 to 9.

In addition, the pCl is preferably 1.0 or higher, more preferably 1.6 or higher, and even more preferably from 1.8 to 3.0.

5) Dislocation Line

Preferably, the tabular particles in the invention are silver halide particles having a dislocation line.

The dislocation line of the tabular particles may be observed by a direct method using a transmission electron microscope at low temperature described, for example, in J. F. Hamilton, Phot. Sci. Eng., 11, 57 (1967), and T. Shiozawa, J. Soc. Phot. Sci. Japan, 35, 213 (1972). That is, sliver halide particles taken out from an emulsion by paying an attention so that a pressure generating dislocation in a particle is not applied are placed on a mesh for electron microscope observation, and are observed by a transmission method in the state where a sample is cooled so as to prevent damage (print out etc.) due to an electron beam. In this process, since as a thickness of the particles is greater, an electron beam becomes difficult to be transmitted, the particles may be observed clearer by using a high pressure-type (200 kV or more with respect to particles having a thickness of 0.25 μm) electron microscope. By a photograph of the particles obtained by the method, a position and a number of dislocation lines per each particle, which are seen from a direction vertical to a main plane, may be obtained.

6) Chemical Sensitization

The silver halide particles of the invention are preferably subjected to chemical sensitization. Chemical sensitization including a chalcogen sensitization such as a sulfur sensitization, a selenium sensitization or a tellurium sensitization, a gold sensitization, and a reduction sensitization may be used. Preferably, a chalcogen sensitization and a gold sensitization may be used in combination.

In a sulfur sensitization, an unstable sulfur compound is used, and unstable sulfur compounds described in P. Glafkides, Chimie et Physique Photographique (published by Paul Montel, 1987, $5^{th}$ edition), and Research Disclosure, vol. 307, No. 307105 may be used. Specific examples include known sulfur compounds such as thiosulfates (for example, hypo), thioureas (for example, diphenylthiourea, triethylthiourea, N-ethyl-N'-(4-methyl-2-thiazolyl)thiourea, carboxymethyltrimethylthiourea), thioamides (for example, thioacetamide), rhodanines (for example, diethylrhodanine, 5-benzylidene-N-ethylrhodanine), phosphine sulfides (for example, trimethylphosphine sulfide), thiohydantoins, 4-oxo-oxazolidine-2-thiones, disulfides or polysulfides (for example, dimorpholine disulfide, cystine, lenthionine), mercapto compounds (for example, cysteine), polythionate, elemental sulfur, or the like, and active gelatin.

In a selenium sensitization, an unstable selenium compound is used, and unstable selenium compounds described in JP-B Nos. 43-13489, 44-15748, JP-A Nos. 4-25832, 4-109240, 4-271341, and 5-40324 may be used. Specific examples include colloidal metal selenium, selenoureas (for example, N,N-dimethylselenourea, trifluoromethylcarbonyltrimethylselenourea, acetyl-trimethylselenourea), selenoamides (for example, selenoacetamide, N,N-diethylphenylselenoamide), phosphine selenides (for example, triphenylphosphine selenide, pentafluorophenyldiphenylphosphine selenide), selenophosphates (for example, tri-p-tolyl selenophosphate, tri-n-butyl selenophosphate), selenoketones (for example, selenobenzophenone), isoselenocyanates, selenocarboxylic acids, selenoesters, diacyl selenides and the like. In addition, non-unstable selenium compounds, for example, selenious acid, potassium selenocyanide, selenazoles, and selenides described in JP-B Nos. 46-4553, and 52-34492 may be used.

In a tellurium sensitization, an unstable tellurium compound is used, and unstable tellurium compounds described in Canadian Patent No. 800958, British Patent Nos. 1,295,462, and 1,396,696, and JP-A Nos. 4-204640, 4-271341, 4-333043, and 5-303157 may be used. Specific examples include telluroureas (for example, tetramethyltellurourea, N,N'-dimethylethylenetellurourea, N,N'-diphenylethylenetellurourea), phosphine tellurides (for example, butyl-diisopropylphosphine telluride, tributylphosphine telluride, tributoxyphosphine telluride, ethoxy-diphenylphosphine telluride), diacyl(di)tellurides (for example, bis(diphenylcarbamoyl)ditelluride, bis(N-phenyl-N-methylcarbamoyl)ditelluride, bis(N-phenyl-N-methylcarbamoyl)telluride, bis(N-phenyl-N-benzylcarbamoyl)telluride, bis(ethoxycarbonyl) telluride), isotellurocyanates, telluroamides, tellurohydrazides, telluroesters (for example, butylhexyl telluroester), telluroketones (for example, telluroacetophenone), colloidal tellurium, (di)tellurides, other tellurium compounds (potassium telluride, telluropentathionate sodium salt) and the like.

In a gold sensitization, gold salts described in the aforementioned P. Glafkides, Chimie et Physique Photographique (published by Paul Montel, 1987, 5$^{th}$ edition), and Research Disclosure, vol. 307, No. 307105 may be used. Specific examples include gold compounds described in U.S. Pat. Nos. 2,642,361, 5,049,484, and 5,049,485 in addition to chloroauric acid, potassium chloroaurate, potassium aurithiocyanate, gold sulfide, and gold selenide. Further, noble metal salts of platinum, palladium, or iridium may be added in combination.

An amount of a chalcogen sensitizing agent used in the invention differs depending on silver halide particles used and a chemical sensitization condition, and is from about $10^{-8}$ mole to about $10^{-2}$ mole, and preferably from about $10^{-7}$ mole to about $5\times10^{-3}$ mole per 1 mole of silver halide.

An amount of a gold sensitizing agent and a noble metal sensitizing agent used in the invention is from about $10^{-7}$ mole to about $10^{-2}$ mole per 1 mole of silver halide. The condition of chemical sensitization in the invention is not particularly limited, but the pAg is preferably from 6 to 11, and more preferably from 7 to 10, the pH is preferably from 4 to 10, and the temperature is preferably from 40° C. to 95° C., and more preferably from 45° C. to 85° C.

In a reduction sensitization, known reducing compounds described in the aforementioned P. Glafkides, Chimie et Physique Photographique (published by Paul Montel, 1987, 5$^{th}$ edition), and Research Disclosure, vol. 307, No. 307105 may be used. Specific examples include aminoiminomethanesulfinic acid (another name, thiourea dioxide), borane compounds (for example, dimethylaminoborane), hydrazine compounds (for example, hydrazine, p-tolylhydrazine), polyamine compounds (for example, diethylenetriamine, triethylenetetramine), stannous chloride, silane compounds, reductones (for example, ascorbic acid), sulfites, aldehyde compounds, and a hydrogen gas. Further, the reduction sensitization may be performed in high pH and silver ion excess atmosphere (so-called silver ripening).

The silver halide emulsion of the invention may be halogen-converted in a surface or a part of the particle at a chemical sensitization step. As a method of conducting halogen conversion, a water-soluble bromide salt such as potassium bromide, sodium bromide or the like, and a water-soluble iodide salt such as potassium iodide or the like may be used alone, or in combination. They may be added as a solid as it is, or as an aqueous solution or a gelatin dispersion. Further, an addition of silver halide fine particles of silver bromide, silver iodidobromide, or silver iodide is preferably used, and they may be used alone, or in combination.

In the case of adding fine particles, an average equivalent spherical diameter of fine particles which are added as fine particles is preferably 0.1 μm or less, and more preferably 0.05 μm or less. The fine particles may be sequentially prepared by supplying an aqueous silver nitrate solution and an aqueous alkali halide solution of an arbitrary composition into a mixing vessel provided in the vicinity of a reaction container, and immediately added to the reaction container. Alternatively, the fine particles may be prepared in another container in a batch manner, and thereafter added. In addition, the silver halide fine particles may contain a heavy metal ion such as iridium, rhodium, platinum or the like, or a compound thereof, if necessary.

The presence of a metal salt at preparation of the emulsion of the invention, for example, at grain formation, at a desalting step, at chemical sensitization, or before coating is preferable depending on the purpose. In the case where a metal ion is doped into a particle, the metal salt is preferably added at grain formation. In the case where the metal salt is used for modifying the particle surface or as a chemical sensitizing agent, the metal salt is preferably added after grain formation, and before completion of chemical sensitization. A method of doping into a whole particle, only a core part of the particle, only a shell part, only an epitaxial part, or only a substrate particle may be selected. Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb or Bi may be used. These metals may be added when they are in the form of a salt which may be dissolved at grain formation, such as an ammonium salt, an acetate salt, a nitrate salt, a sulfate salt, a phosphate salt, a hydroxide salt, or a hexacoordinate complex salt, and a tetracoordinate complex salt. Specific examples include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. A ligand of a coordination compound may be selected from halo, aquo, cyano, cyanate, thiocyanate, nitrosyl, thionitrosyl, oxo and carbonyl.

Only one of these metal compounds may be used, or two, three or more of these metal compounds may be used in combination.

An addition of chalcogen compounds during preparation of an emulsion is useful in some cases as described in U.S. Pat. No. 3,772,031. In addition to S, Se, or Te, a cyan salt, a thiocyan salt, a selenocyanic acid, a carbonate salt, a phosphate salt, or an acetate salt may be present.

Chemical sensitization may be performed in the presence of a so-called chemical sensitization aid. As a useful chemical sensitization aid, compounds which are known to suppress fog and increase the sensitivity during chemical sensitization, such as azaindene, azapyridazine, and azapyrimidine are used. Examples of a chemical sensitization aid or a modifier are described in U.S. Pat. Nos. 2,131,038, 3,411,914, and 3,554,757, JP-A No. 58-126526, and DaFin, "Photographic Emulsion Chemistry", pages 138-143.

7) Oxidizing Agent Treatment

It is preferable to use an oxidizing agent for silver in a production step of the emulsion of the invention. The oxidizing agent for silver refers to a compound having a function of acting on metal silver to convert it into a silver ion. Particularly, a compound which converts an extremely fine silver particle produced as a byproduct in a formation process of silver halide particles or a chemical sensitization process, into a silver ion is effective. In these processes, the silver ion produced herein may form a water insoluble silver salt such as silver halide, silver sulfide, silver selenide or the like, or may form a water soluble silver salt such as silver nitrate. The oxidizing agent for silver may be an inorganic substance, or an organic substance. Specific examples of the inorganic oxidizing agent include ozone, hydrogen peroxide and its adducts (for example, $NaBO_2.H_2O_2.3H_2O$, $2NaCO_3.3H_2O_2$, $Na_4P_2O_7.2H_2O_2$, $2Na_2SO_4.H_2O_2.2H_2O$), oxygen acid salts such as peroxyacid salts (for example, $K_2S_2O_8$, $K_2C_2O_6$, $K_2P_2O_8$), peroxy-complex compounds (for example, $K_2[Ti(O_2)C_2O_4].3H_2O$, $4K_2SO_4.Ti(O_2)OH.SO_4.2H_2O$, $Na_8[VO(O_2)(C_2H_4)_2.6H_2O]$, permanganate salts (for example, $KMnO_4$), and chromate salts (for example, $K_2Cr_2O_7$), halogen elements such as iodine and bromine, perhalogen acid salts (for example, potassium periodate), high atomic value metal salts (for example, potassium hexacyanoferrate), and thiosulfonate salt.

Examples of the organic oxidizing agent include quinones such as p-quinone, organic peroxides such as peracetic acid and perbenzoic acid, and compounds which release an active halogen (for example, N-bromosuccinimide, Chloramine T, or Chloramine B).

Combined use of the reduction sensitization mentioned above and the oxidizing agent for silver is a preferable embodiment.

8) Spectral Sensitization

It is preferable that the silver halide photosensitive material of the invention is spectrally sensitized. Examples of a spectral sensitizing dye which may be used in spectral sensitization include cyanine dyes, merocyanine dyes, complex cyanine dyes, complex merocyanine dyes, holopolar cyanine dyes, hemicyanine dyes, styryl dyes, hemioxonol dyes and the like. A particularly useful spectral sensitizing dye is dyes belonging to cyanine dyes, merocyanine dyes and composite merocyanine dyes. For these dyes, as a basic heterocyclic nucleus, any nuclei which are usually utilized in cyanine dyes may be applied. That is, a pyrroline nucleus, an oxazoline nucleus, a thiazoline nucleus, a selenazoline nucleus, a pyrrole nucleus, an oxazole nucleus, a thiazole nucleus, a selenazole nucleus, an imidazole nucleus, a tetrazole nucleus, a pyridine nucleus, a tellurazole nucleus; nuclei in which an alicyclic hydrocarbon ring is fused with these nuclei; and nuclei in which an aromatic hydrocarbon ring is fused with these nuclei, that is, an indolenine nucleus, a benzindolinine nucleus, an indole nucleus, a benzoxazole nucleus, a naphthoxazole nucleus, a benzimidazole nucleus, a naphthoimidazole nucleus, a benzothiazole nucleus, a naphthothiazole nucleus, a benzoselenazole nucleus, a naphthoselenazole nucleus, a quinoline nucleus, a benzotellurazole nucleus and the like may be applied. These heterocyclic nuclei may substitute for a hydrogen atom on a carbon atom.

As a nucleus having a ketomethylene structure for the merocyanine dye or the complex merocyanine dye, any nucleus which is usually utilized in a merocyanine dye may be applied. A particularly useful nucleus includes a 5-membered or 6-membered heterocyclic nucleus such as a pyrazolin-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus, and a 2-thioselenazolidine-2,4-dione nucleus.

A timing for addition of the spectral sensitizing dye is not particularly limited, but the dye may be added at an arbitrarily timing from a grain formation step to immediately before coating. Specifically, there are a method of addition at formation of silver halide particles, a method of addition in a step of desalting a silver halide emulsion, a method of addition immediately before a step of chemical ripening a sliver halide emulsion (chemical sensitization), and a method of addition at chemical ripening of a silver halide emulsion, a method of addition after chemical ripening of a sliver halide emulsion and a method of addition at preparation of a coating solution, and preferably the dye is added before addition of the gold sensitizing agent, and the chalcogen sensitizing agent, that is, before chemical sensitization with these compounds. In addition, after a spectral sensitizing dye is added at a temperature of 25° C. or higher and lower than 55° C., a temperature is raised from the addition temperature, then chemical ripening is performed, and thereby the dye may be uniformly adsorbed to each silver halide particles.

In order to add the spectral sensitizing dye to the silver halide emulsion of the invention, it may be directly dispersed in the emulsion, or it may be dissolved in a solvent such as water, methanol, ethanol, propanol, acetone, methylcellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide or the like, which may be used alone or in a mixed solvent, and the solution may be added to the emulsion. In addition, a method of dissolving a dye in a volatile organic solvent, dispersing this solution in water or a hydrophilic colloid, and adding this dispersion to the emulsion, as described in U.S. Pat. No. 3,469,987 and the like, a method of dispersing a water-insoluble dye in an aqueous solvent without dissolving the dye, and adding this dispersion to the emulsion, as described in JP-B No. 46-24185 and the like, a method of dissolving a dye in an acid, adding this solution to the emulsion, or preparing an aqueous solution in the presence of an acid or base, and adding the aqueous solution to the emulsion, as described in JP-B Nos. 44-23389, 44-27555, 57-22091, and the like, a method of preparing an aqueous solution or a colloid dispersion by coexistence of a surfactant, adding this to the emulsion, as described in U.S. Pat. No. 3,822,135, and U.S. Pat. No. 4,006,025, a method of directly dispersing a dye in a hydrophilic colloid, and adding the dispersion to the emulsion, as described in JP-A Nos. 53-102733, and 58-105141, and a method of dissolving a dye using a compound causing red shift, and adding this solution to the emulsion, as described in JP-A No. 51-74624, may be used. In addition, for dissolution, an ultrasonic wave may be used.

A combination of spectral sensitizing dyes is frequently used, particularly, for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,614,609, 3,837,862, and 4,026,707, British Patent Nos. 1,344,281, and 1,507,803, JP-B Nos. 43-4936, and 53-12375, and JP-A Nos. 52-110618, and 52-109925.

Further, these sensitization dyes may be used in combination with a dye which itself does not exhibit the spectral sensitization action, or any compound known to be named as so-called supersensitizer, which is a substance which does not substantially absorbs visible light, but is combined with a sensitization dye to exhibit remarkable increase in spectral sensitization. Representative examples of the supersensitizer include bispyridinium salts as described in JP-A No. 59-142541 and the like, stilbene derivatives described in JP-B No. 59-18691 and the like, water-soluble bromide or water-soluble iodide such as potassium bromide, potassium iodide described in JP-B No. 49-46932 and the like, condensates of an aromatic compound and formaldehyde described in U.S. Pat. No. 3,743,510 and the like, cadmium salts, azaindene compounds and the like.

A spectral sensitizing dye is added to the emulsion after chemical ripening, or before chemical ripening. It is most preferable that the spectral sensitizing dye is added to the silver halide particles of the invention during chemical ripening or before chemical ripening (for example, at grain formation, or at physical ripening).

In addition, examples of a method of preparing a solid fine particle dispersion include a method of preparing a solid dispersion by dispersing the powder of a spectral sensitizing dye in a proper solvent with a ball mill, a colloid mill, a vibration ball mill, a sand mill, a jet mill, a roller mill or ultrasonics In this process, a protective colloid (for example, polyvinyl alcohol), or a surfactant (for example, an anionic surfactant such as sodium triisopropylnaphthalenesulfonate (a mixture of compounds having the three isopropyl groups in different substitution sites)) may be used. In the mills described above, as a dispersing media, beads of zirconium are normally used, and Zr eluted from these beads is incorporated in a dispersion in some cases. Although depending on the dispersing condition, the amount of Zr incorporated in the dispersion is generally in a range of from 1 ppm to 1000.

In the case where the amount of Zr in a photosensitive material is 0.5 mg or less per 1 g of silver, it is practically acceptable.

Preferably, an antiseptic agent (e.g. benzoisothiazolinone sodium salt) is contained in an aqueous dispersion.

3. Photographic Additives

The silver halide emulsion used in the invention may contain various compounds for the purpose of preventing fog in a step of producing a photosensitive material, during storage, or during photographic processing, or for purpose of stabilizing photographic performance. That is, many compounds known as an antifoggant or a stabilizer such as thiazoles (for example, benzothiazolium salt), nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazole or the like), mercaptopyrimidines, mercaptotriazines, thioketo compounds such as oxadolinethione, azaindenes (for example, triazaindenes, tetraazaindenes (particularly, 4-hydroxy-6-methyl(1,3,3a,7) tetraazaindene), and pentaazaindenes) or the like may be added. For example, those described in U.S. Pat. Nos. 3,954,474, and 3,982,942, and JP-B No. 52-28660 may be used. As one of preferable compounds, there is a compound described in JP-A No. 63-212932. The antifoggant and the stabilizer may be added, depending on the purpose, at various timings of before grain formation, during grain formation, after grain formation, in a desalting step, at dispersion after desalting, before chemical sensitization, during chemical sensitization, after chemical sensitization, or before coating.

In the invention, it is also preferable that before completion of chemical sensitization, chemical sensitization is performed by the existence of a nucleic acid or a degradation product thereof. A nucleic acid or a degradation product thereof which is described in JP-A No. 62-67541 may be used.

Examples of a nucleic acid used in the invention include deoxyribonucleic acid (DNA) and ribonucleic acid (RNA). Examples of a degradation product of nucleic acid include those products during degradation, and single substances such as adenine, guanine, uracil, cytosine, thymine and the like. A particularly preferable degradation product of nucleic acid is adenine. These may be used alone, or may be used in combination. A combination of a nucleic acid and a degradation product of nucleic acid may be used. An addition amount of a nucleic acid or a degradation product thereof differs depending on the degradation product of nucleic acid, but is in the range of 20 mg or more, and preferably from 100 mg to 1 g per 1 mole of silver halide. A total addition amount of these nucleic acid and degradation product of nucleic acid is sufficiently the aforementioned amount whether they are used alone, or they are used in a combination of two or more of them.

4. Other Constituent Components.

The silver halide photosensitive material of the invention may have a non-photosensitive layer, such as a crossover light cut layer, a surface protective layer or the like, in addition to the photosensitive silver halide emulsion layer. The non-photosensitive layer may contain a dye, colloidal silica, polymer latex, a matting agent or the like, in addition to a surfactant such as a fluorocarbon compound and a non-fluorocarbon compound.

1) Crossover Light Cut Layer

In the photosensitive material of the invention, a crossover light cut layer may be provided between a photosensitive emulsion layer and a support, if necessary, for the purpose of obtaining a sharp image. The crossover light cut layer is a layer peculiar to a medical X-ray photosensitive material having a silver halide emulsion layer on both sides of a support, and is the means to solve a problem that light from one side of the support passes through the support, and influences on a silver halide emulsion layer on the other side, thereby, deteriorating image quality. The crossover light cut layer may function also as the non-photosensitive hydrophilic colloid layer. A dye corresponding to a photosensitive wavelength region is added to the crossover light cut layer. Any dye may be used as far as it does not leave harmful absorption after development processing.

Particularly preferably, the dye is added in the form of a solid fine particle dispersion. A method of adding the dye in the form of a solid fine particle dispersion is described in JP-A Nos. 2-264936, 3-210553, 3-210554, 3-238447, 4-14038, 4-14039, 4-125635, 4-338747, and 6-27589. The dye which may be used includes, for example, dyes of the formulae (I) to (VII), exemplified compounds I-1 to 1-37, II-1 to II-6, III-1 to III-36, IV-1 to IV-16, V-1 to V-6, VI-1 to VI-13, and VII-1 to VII-5 described in JP-A No. 4-211542; dye of formula (I), exemplified compounds 1 to 6 described in JP-A No. 8-73767; and dyes of formulae (VIII) to (XII), exemplified compounds VIII-1 to VIII-5, IX-1 to IX-10, X-1 to X-21, XI-1 to XI-6, and XII-1 to XII-7 described in JP-A No. 8-87091.

In addition, a method of adsorbing a known dye onto a mordant, a method of dissolving a known dye in an oil, and emulsifying and dispersing into an oil droplet, a method of adsorbing a dye onto the surface of an inorganic substance as described in JP-A No. 3-5748, a method of adsorbing a dye onto polymer as described in JP-A No. 2-298939 and the like may be utilized. As a method for providing the crossover light cut layer to a photosensitive material, any method described in each specification may be utilized.

3) Dye

The photosensitive material of the invention may contain a dye for the purpose of detecting a position of the photosensitive material. The dye is desired to have an absorption spectrum corresponding to a maximum sensitivity wavelength of a detection sensor, and any dye may be used as far as it dose not leave harmful absorption after developing processing. Preferably, a dye or a fine particle dispersion thereof having absorption maximum at 700 nm to 1400 nm is used.

Examples include:

(1) A water-soluble dye which may be discolored at processing, including cyanine dyes, pyrylium dyes and aminium dyes of formulae (I) to (IV), exemplified compounds I-1 to I-6, II-1 to II-4, III-1 to III-4, and IV-1 to IV-5, described in JP-A No. 3-211542;

(2) A dye in the form of a solid fine particle dispersion which may be discolored at processing, including cyanine dyes, pyrylium dyes and aminium dyes of formulae (I) to (IV), exemplified compounds I-1 to I-28, II-1 to II-10, III-1 to III-6, and IV-1 to IV-7, described in JP-A No. 3-138640; and (3) A dye which is not discolored at processing, including tricarbocyanine dyes of formula (I) or formula (II) having a carboxy group, exemplified compounds 1 to 33, described in Japanese Patent Application No. 6-227983, tetracarbocyanine dyes of formula (I) to formula (II) having a carboxy group, exemplified compounds 1 to 19, described in Japanese Patent Application No. 6-279297, cyanine dyes of formula (1) to formula (3) having no acid group, in which specific examples of the compound include 1 to 63, described in Japanese Patent Application No. 7-208569, and lake-type cyanine dyes of formula [1], exemplified compounds No. 1 to No. 37, described in JP-A No. 8-333519.

In addition to these dyes, pyrylium dyes described in JP-A No. 62-299959, light scattering particles described in JP-A No. 63-131135, cyanine dyes described in JP-A No. 1-266536, solid fine particle dispersions of oxonol dyes described in JP-A No. 2-282244, holopolar-type cyanine dyes described in JP-A No. 3-136038, polymer-type cyanine dyes described in JP-A No. 7-253639, tin-doped indium oxide (ITO) powder described in JP-A No. 7-113072, and $Yb^{3+}$ compounds described in JP-A No. 9-5913 may also be utilized.

The layer to which a dye for the purpose of detecting a position of the photosensitive material is added is not particularly limited, and the dye may be added to a silver halide emulsion layer, the non-photosensitive hydrophilic colloid layer of the invention, a surface protective layer or the like. Each addition method usable may be described in each specification.

The photosensitive material of the invention may contain a compound shown by formula (I) of JP-A No. 2004-094083 for the purpose of improving a color tone of a silver image. Besides the compound, a dye may be added. As the dye, a dye having the predetermined maximum absorption wavelength is selected from a pyrazoloazole dye, an anthraquinone dye, an azo dye, an azomethine dye, an oxonol dye, a carbocyanine dye, a styryl dye, a triphenylmethane dye, an indoaniline dye, an indophenol dye and the like. Among them, an anthraquinone dye of formula (I) described in JP-A No. 5-34858, an azomethine dye of formula (I) described in JP-A No. 4-247449 and of formula (I) described in JP-A No. 4-296845, an indoaniline dye included in formula (I) described in JP-A No. 5-43809, and an azo dye described in JP-A No. 5-341441 are useful.

Specific examples of the anthraquinone dye include compounds 1-9 described in JP-A No. 5-341441, compounds 3-6 to 3-18, and 3-23 to 3-38 described in JP-A No. 5-165147. Specific examples of the azomethine dye include compounds 17 to 46 described in JP-A No. 5-341441. Specific examples of the indoaniline dye include compounds 11 to 19 described in JP-A No. 5-289227, a compound 47 described in JP-A No. 5-341441, and compounds 2-10 to 2-11 described in JP-A No. 5-165147. Specific examples of the azo dye include compounds 10 to 16 described in JP-A No. 5-341441.

A method of adding the dye to a photosensitive material for the purpose of improving a color tone of a silver image is described in each specification.

3) Colloidal Silica

The silver halide photosensitive material of the invention may contain colloidal silica. The colloidal silica has an average particle diameter of from 1 nm to 1000 nm, preferably from 5 nm to 500 nm, and even more preferably from 5 nm to 100 nm. The colloidal silica contains silicon dioxide as a main component thereof, and may contain alumina or sodium alginate as a minor component.

Specific examples of the colloidal silica include SNOWTEX 20, SNOWTEX 30, SNOWTEX C, SNOWTEX 0 and the like, which are the trade names of Nissan Chemical Industries, Ltd. (Japan, Tokyo).

A layer containing the colloidal silica may be an arbitrary hydrophilic colloid layer such as a surface protective layer, an intermediate layer, a silver halide emulsion layer, an antihalation layer, an undercoat layer, a filter layer, and a back layer. Particularly preferably, the colloidal silica is contained in a surface protective layer or a silver halide emulsion layer in view of improving pressure resistance.

A content of the colloidal silica is preferably from 1% by weight to 200% by weight, and particularly preferably from 10% by weight to 100% by weight based on the weight of hydrophilic colloid of the hydrophilic colloid layer.

The layer containing the colloidal silica preferably contains a plastic polymer latex, if necessary.

4) Polymer Latex

The silver halide photosensitive material of the invention may contain a polymer latex obtained by polymerizing a water-insoluble monomer.

As the monomer, for example, acrylic acid esters, methacrylic acid esters, and divinylbenzene described in JP-A No. 7-230135, page 2, second column, lines 5 to 17 may be used.

Such polymer latex may be obtained by copolymerizing the monomer described above with other monomer. The other monomer to be copolymerized includes, for example, monomers described in JP-A No. 7-230135, page 2, second column, line 32 to page 4, column 1, line 35, and among them, acrylic acid esters, methacrylic acid esters, vinyl esters, styrenes, or olefins are preferably used.

Specific examples of the polymer latex include Lx-1 to Lx-21 described in JP-A 7-230135.

5) Matting Agent

The silver halide photosensitive material of the invention may preferably contain a matting agent of No. 1 to No. 8 described in Example 1 of JP-A No. 6-194779. Alternatively, compound examples 1 to 9 described in paragraph [0023] of JP-A No. 6-138572 may be preferably used.

With respect to the size or the like of these matting agents, the size and an amount thereof described in paragraph [0049] of JP-A No. 6-194779 may be preferably used. In addition, two or more matting agents having different size may be used by mixing them. With respect to the particle size distribution of the matting agent, monodispersed particles having a variation coefficient of from 3% to 30% may be used, or polydispersed particles having a variation coefficient of 30% or more may be used.

6) Coating and Drying Step

Generally, after coating of an aqueous coating solution containing hydrophilic colloid as a binder such as gelatin on a support, the silver halide photosensitive material is cooled to be solidified in low temperature air of dry bulb temperature of −10° C. to 20° C., and then dried by raising a temperature. The weight ratio of gelatin to water immediately after coating is normally around 3000%.

The coating solution usually contains various additives such as a hydrophilic colloidal binder, silver halide particles, a surfactant, a plasticizer such as a polymer latex, a gelatin hardener, a dye, a spectral sensitizing dye, a matting agent and the like.

In the invention, upon drying after coating of the coating solution of the hydrophilic colloid layer, the material is preferably dried at wet bulb temperature of 20° C. or lower, preferably 19° C. to 10° C., until the water content becomes 100% or less based on the dry amount of the binder of the total coating layer on the side having the silver halide emulsion layer.

When two or more layers of the hydrophilic colloid layer are coated at the same time, and dried (that is, when the coating layer to be dried is two or more layers), the water content indicates a sum of water content of all layers, and a dry amount of the binder indicates a sum of the dry amount (dry weight) of the binder of all layers.

The wet bulb temperature is a temperature of a water droplet in the equilibrium state with wet air, and as lower a humidity of the air is, lower the temperature is. In the constant rate drying term of a drying step, a wet bulb temperature of the dry air is approximately equal to a surface temperature of a coating sample.

In addition, an environmental condition, when the photosensitive material is wound into a roll after coating and drying, is preferably at an absolute humidity of 1.4% by weight or less, and preferably 1.3% by weight to 0.6% by weight. In the invention, slitting and cutting of the silver halide photosensitive material, which has been wound into a roll after coating and drying, is preferably conducted under an environment of an absolute humidity of 1.4% by weight or less, and preferably 1.3% by weight to 0.6% by weight.

The absolute humidity (% by weight) represents a condition of the wet air, and indicates a ratio of water vapor amount (kg) in the wet air to an amount (kg) of the dry air in the wet air.

7) Slitting, Cutting and Wrapping

The silver halide photosensitive material is enveloped with a wrapping material having moistureproof, its opening is sealed by a heat sealing, so that the absolute humidity in the wrapping material becomes 1.4% by weight or lower, and preferably 1.1% by weight to 0.6% by weight.

Further, after slitting and cutting of the silver halide photosensitive material, the silver halide photosensitive material is preferably subjected to seasoning under atmosphere of the absolute humidity of 1.4% by weight or lower, and thereafter heat-sealed to make airtight into the wrapping body under the same atmosphere.

8) Other Additives

Various additives used in the silver halide photographic emulsion and the silver halide photosensitive material of the invention are not particularly limited. For example, those described in the following relevant places of JP-A No. 2-68539 may be used.

(1) Silver Halide Emulsion and Methods for Producing the Same

JP-A No. 2-68539, from page 8, right lower column, line 6 from bottom to page 10, right upper column, line 12

(2) Chemical Sensitization Method

Ibid., from page 10, right upper column, line 13 to left lower column, line 16

(3) Antifoggant, Stabilizer

Ibid., from page 10, left lower column, line 17 to page 11, left upper column, line 7, and from page 3, left lower column, line 2 to page 4, left lower column (4) Spectral Sensitizing Dye Ibid., from page 4, right lower column, line 4 to page 8, right lower column (5) Surfactant, Antistatic Agent Ibid., from page 11, left upper column, line 14 to page 12, left upper column, line 9

(6) Matting Agent, Lubricant

Ibid., from page 12, left upper column, line 10 to right upper column, line 10

Plasticizer

Ibid., from page 14, left lower column, line 10 to right lower column, line 1

(7) Hydrophilic Colloid

Ibid., from page 12, right upper column, line 11 to left lower column, line 16

(8) Hardener

Ibid., from page 12, left lower column, line 17 to page 13, right upper column, line 6

(9) Support

Ibid., from page 13, right upper column, lines 7 to 20

(10) Dye, Mordant

Ibid., from page 13, right lower column, line 1 to page 14, left lower column, line 9

5. Imagewise Exposure

The industrial X-ray photosensitive material of the invention is used for irradiating a subject with X-rays, and detecting an intensity of transmitted X-rays. As a radiation source for exposure, in addition to X-rays, γ-rays from a radioactive isotope such as Co, high energy rays or particle rays from a particle accelerator are used. Usually, these radiation rays are directly irradiated to the silver halide photosensitive material, or they are irradiated to a metal foil to release a secondary electron beam, and this secondary beam is utilized to finally expose a photosensitive material. Therefore, these are all image recording by irradiation with radiation rays other than light. Upon recording by the photosensitive material, the radiation is frequently irradiated while the photosensitive material is stacked on a thin metal foil such as a lead foil.

In addition to imagewise exposing using a lead foil metal intensifying screen, the photosensitive material of the invention may be used to perform X-ray imaging using a fluorescent intensifying screen, for example, containing the following fluorescent material.

(Blue Light Emitting Fluorescent Material)

$Y_2O_2S$:Tb, LaOBr:Tb, BaFCl:Eu (Green Light Emitting Fluorescent Material)

$Gd_2O_2S$:Tb, $LaO_2S$:Tb

A UV light emitting fluorescent material includes M' phase $YTaO_4$ alone or compounds in which Gd, Bi, Pb, Ce, Se, Al, Rb, Ca, Cr, Cd, Nb or the like is added to the M' phase $YTaO_4$, compounds in which Gd, Tm, Gd and Tm, Gd and Ce, or Tb are added to LaOBr, an oxide of HfZr alone or compounds in which Ge, Ti, an alkali metal or the like is added to the oxide of HfZr, $Y_2O_3$ alone or compounds in which Gd or Eu is added to the $Y_2O_3$, compounds in which Gd is added to $Y_2O_2S$, and compounds in which Gd, Tl or Ce is added as an activator to various fluorescent materials. A particularly preferable compound includes M' phase $YTaO_4$ alone or compounds in which Gd or Sr is added to M' phase $YTaO_4$, compounds in which Gd, Tm, or Gd and Tm are added to LaOBr, and an oxide of HfZr or compounds in which Ge, Ti or an alkali metal is added to the oxide of HfZr.

A particle diameter of the fluorescent material is preferably from 1 μm to 20 μm, but may be changed in view of the required sensitivity, and a problem in production. A coating amount thereof is preferably from 400 g/m$^2$ to 2000 g/m$^2$, but may not be determined depending on the required sensitivity and image quality. In addition, a particle size distribution may be declined from the vicinity of a support to a surface in one intensifying screen. In this case, generally, it is known that the particle size on a surface is made to be greater. The space filling rate of the fluorescent material is 40% or more, and preferably 60% or more.

In the case where the intensifying screen is provided on both sides of the photosensitive material to be irradiated, a coating amount of the fluorescent material on an X-ray incident side and that of an opposite side may be different from each other. Generally, due to shielding by a intensifying screen on an X-ray incident side, particularly when a high sensitivity system is required, the coating amount of the fluorescent material on the X-ray incident side is made to be smaller.

A support used in an intensifying screen in the invention includes papers, metal plates, polymer sheets or the like. Generally, a flexible sheet of such as polyethylene terephthalate is used. A light reflecting agent or a light absorbing agent may be added to the support, if necessary, or another layer containing those may be provided on a surface.

If necessary, fine irregularities may be imparted to the support surface, or a tacky layer for increasing an adhering force with the fluorescent material layer, and an electrically conductive layer as undercoating may be provided. Specific examples of the reflecting agent include zinc oxide, titanium oxide, barium sulfate and the like. In view of a short wavelength of light emitted from the fluorescent material, titanium oxide, or barium sulfate is preferable. The reflecting agent may be present not only in the support, or between the support and the fluorescent material layer, but also in the fluorescent material layer. When present in the fluorescent material layer, the reflecting agent is preferably locally present in the vicinity of the support.

Specific examples of the binder for the intensifying screen in the invention include proteins such as gelatin, polysaccharides such as dextran and corn starch, natural polymers such as gum Arabic; synthetic polymers such as polyvinyl butyral, polyvinyl acetate, polyurethane, polyalkyl acrylate, polyvinylidene chloride, nitrocellulose, a fluorocarbon polymer and polyester, mixtures thereof and copolymers thereof. A preferable binder has high transmittance with respect to light emitted from the fluorescent material, as fundamental performance. In this point, examples include gelatin, corn starch, an acrylic polymer, an olefin polymer containing fluorine, a copolymer using olefin containing fluorine as a copolymer component, a styrene/acrylonitrile copolymer, and the like. These binders may have a functional group which is crosslinked with a crosslinking agent. In addition, depending on the required image quality, an absorbing agent for light emission from the fluorescent material may be added to the binder, or a binder having a low transmittance may be used. Examples of the absorbing agent include pigments, dyes, and ultraviolet absorbing compounds. A ratio of the fluorescent material to the binder is generally 1:5 to 50:1, preferably 1:1 to 5:1 as the volume ratio. The ratio of the fluorescent material to the binder may be uniform, or may be not uniform in the thickness direction.

The fluorescent material layer is usually formed by a coating method using a coating solution in which the fluorescent material is dispersed in a binder solution. Examples of a solvent for the coating solution include water, organic solvents such as an alcohol, chlorine-containing hydrocarbon, ketone, ester, ether, and an aromatic compound, and a mixture thereof.

A dispersion stabilizer of a fluorescent material particle, such as phthalic acid, stearic acid, caproic acid, a surfactant or the like, and a plasticizer such as phosphoric acid ester, phthalic acid ester, glycolic acid ester, polyester, polyethylene glycol or the like may be added to the coating solution.

The intensifying screen in the invention may have a protective layer on the fluorescent material layer. For providing the protective layer, a method of coating on the fluorescent material layer, or a method of preparing a protective layer film separately and thereafter laminating it are generally used. In the coating method, the protective layer may be coated at the same time with the fluorescent material layer, or the protective layer may be provided after the fluorescent material layer is coated and dried. The protective layer may contain a binder similar to the binder of the fluorescent material layer, or may contain a different substance. Examples of a substance used in the protective layer include, in addition to materials listed for the binder of the fluorescent material layer, cellulose derivatives, polyvinyl chlorides, melamines, phenol resins, and epoxy resins. Examples of a preferable material include gelatin, corn starch, an acryl polymer, an olefin polymer containing fluorine, a polymer having olefin monomer containing fluorine as a copolymer component, a styrene/acrylonitrile copolymer and the like. A thickness of the protective layer is generally from 1 μm to 20 μm, preferably from 2 μm to 10 μm, and more preferably from 2 μm to 6 μm.

A surface of the protective layer of the invention is subjected to embossing. In addition, a matting agent may be present in the protective layer, or a substance having light scattering property with respect to emitted light depending on a desired image, for example, titanium oxide may be present therein.

Slipping property of surface may be imparted to the protective layer of intensifying screen in the invention. Examples of a slipping agent preferably include a polysiloxane skeleton-containing oligomer, and a perfluoroalkyl group-containing oligomer.

Electric conductivity may be imparted to the protective layer in the invention. Examples of the electric conductivity imparting agent include white or transparent inorganic electrically conductive substances and organic antistatic agents. Examples of a preferable inorganic electrically conductive substance include ZnO powder, a whisker, $SnO_2$, ITO and the like.

6. Processing System Such as Development and Fixation

1) Development

As a method of development in the invention, methods described in U.S. Pat. No. 5,498,511, and JP-A Nos. 7-16832, 8-54712, 9-329875, and 10-26815 may be referred.

A developing solution which processes the photosensitive material of the invention, preferably includes hydroquinone, ascorbic acid or erythorbic acid (diastereomer of ascorbic acid), or a derivative of at least one of them. Ascorbic acid and a derivative thereof are described in U.S. Pat. No. 2,688,549, JP-B No. 36-17599, JP-A Nos. 3-249756, and 4-270343 and the like.

Specific examples of the compounds include compounds described in U.S. Pat. No. 2,688,549, from page 1, first column, line 22 to page 1, second column, line 33, compounds described in JP-B No. 36-17599, page 1, left column, lines 21 to 26, compounds I-1 to I-8, and II-1 to II-4 described in JP-A No. 3-249756, page 4, and compounds described in JP-A No. 4-270343, page 4, fifth column, lines 40 to 50.

Among them, ascorbic acid or erythorbic acid (diastereomer of ascorbic acid) and an alkali metal salt thereof such as lithium salt, sodium salt, and potassium salt thereof are preferable.

A developer is usually preferably used at an amount of from 0.01 mol/L to 0.8 mol/L, and particularly preferably from 0.1 mol/L to 0.4 mol/L.

In the invention, it is preferable that an auxiliary developer exhibiting superadditivity is used in combination with the developer. The auxiliary developer exhibiting superadditivity includes a 1-phenyl-3-pyrazolidone auxiliary developer. The 1-phenyl-3-pyrazolidone auxiliary developer includes 1-phenyl-3-pyrazolidone, 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-4-pyrazolidone, 1-p-tolyl-4-methyl-4-hydroxymethyl-3-pyrazolidone and the like.

Among them, 1-phenyl-4-methyl-4-hydroxymethyl-3-pyrazolidone is preferable.

In the invention, when the 1-phenyl-3-pyrazolidone auxiliary developer is used in combination with the developer, it is preferably used in an amount of from 0.001 mol/L to 0.1 mol/L, and particularly preferably in an amount of from 0.005 mol/L to 0.05 mol/L.

In addition, another auxiliary developer exhibiting superadditivity is a p-aminophenol auxiliary developer. The p-aminophenol auxiliary developer includes N-methyl-p-aminophenol, N-(β-hydroxyethyl)-p-aminophenol, N-(4-hydroxyphenyl)-glycine, 2-methyl-p-aminophenol, p-benzylaminophenol and the like. Among them, N-methyl-p-aminophenol is preferable.

In the invention, when the p-aminophenol auxiliary developer is used in combination with the developer, it is preferably used in an amount of from 0.001 mol/L to 0.1 mol/L, and particularly preferably in an amount of from 0.005 mol/L to 0.05 mol/L.

Specific examples of an antifoggant to be added to the developing solution include azole compounds (for example, benzothiazoliums, benzimidazoliums, imidazoles, benzimidazoles, nitroindazoles, triazoles, benzotriazoles, tetrazoles, triazines and the like), mercapto compounds (for example, mercaptothiazoles, mercaptobenzothiazoles, mercaptoimidazoles, mercaptobenzimidazoles, mercaptobenzoxazoles, mercaptothiazoles, mercaptooxadiazoles, mercaptotetrazoles, mercaptopyrimidines, mercaptotriazines and the like) and the like.

Particularly, as benzotriazoles, 5-methylbenzotriazole, 5-bromobenzotriazole, 5-chlorobenzotriazole, 5-butylbenzotriazole or benzotriazole may be used. As nitroindazoles, 5-nitroindazole, 6-nitroindazole, 4-nitroindazole, 7-nitroindazole, 3-cyano-5-nitroindazole or the like may be used.

In the invention, a silver stain preventing agent, such as compounds described in JP-B Nos. 56-46585, 62-4702, 62-4703, U.S. Pat. No. 4,252,215, U.S. Pat. No. 3,318,701, JP-A Nos. 58-203439, 62-56959, 62-178247, 1-200249, 5-503179, and 5-53257 may be used in a developing solution.

2) Fixation

In the invention, various known fixing solutions may be used. For example, there is a well-known aqueous solution containing thiosulfate, in which the pH is 3.8 or higher, and preferably 4.2 to 6.2. The fixing agent includes sodium thiosulfate, ammonium thiosulfate and the like. A concentration of the fixing agent may be arbitrarily changed. The fixing solution may contain a water-soluble aluminum salt which acts as a hardener. Specific examples of the water-soluble aluminum salt include aluminum chloride, aluminum sulfate, potassium alum and the like. In the fixing solution, tartaric acid, citric acid, gluconic acid, or a derivative thereof may be contained alone, or in combination of two or more of them. These compounds are preferably added at 0.005 mole or more per 1 L of the fixing solution, and particularly effectively at 0.01 mol/L to 0.03 mol/L, which is effective. The fixing solution, if necessary, may contain sulfite or bisulfate at 10 g or more, and preferably 50 g or more per 1 L of a solution as a preservative. Acetic acid or boric acid is preferably contained at 0.2 mole or more, and more preferably at 0.5 mole or more, per 1 L of a solution as a pH buffer. In addition, the fixing solution may contain a pH adjusting agent (for example, sulfuric acid), a chelating agent having an ability of converting hard water into soft water, and a compound described in JP-A No. 62-78551.

A fixation promoting agent, such as a thiourea derivative or an alcohol having a triple bond in the molecule described in JP-B No. 45-35754, JP-A Nos. 58-122535, and 58-122536, thioethers, or cyclodextran ethers, crown ethers, diazacycloundecene or di(hydroxyethyl)butylamine which makes an anion free, described in U.S. Pat. No. 4,126,459 may be contained. Mesoion compounds described in JP-A No. 7-5654, and JP-A No. 6-273898 may be contained.

3) Washing, and Stabilization

A washing bath or stabilizing bath is preferably provided with an anti-fungal means. As the anti-fungal means, a ultraviolet irradiation method described in JP-A No. 60-263939, a method of using magnetic field described in JP-A No. 60-263940, a method of using an ion exchange resin so as to be pure described in JP-A No. 61-131632, and a method of using an anti-fungal agent described in JP-A Nos. 61-115154, 62-153952, 62-220951, and 62-20953 may be used together.

Further, microbiocides, anti-fungal agents, and surfactants described in L. F. West, "Water Quality Criteria", Photo. Sci. & Eng., Vol. 9 (1965), M. W. Beach, "Microbiological Growth in Motion-picture Processing", SMTPE Journal, Vol. 85 (1976), R. D. Deegan, "Photo Processing Wash Water Biocides", J. Imag. Sci. & Tech., Vol. 10, No. 6 (1984) and JP-A Nos. 57-8542, 57-58143, 58-105145, 57-132146, 58-18631, 57-97530, 57-157244, 6-118583, and 8-248589 may be used together.

Still further, in the washing bath or stabilizing bath, isothiazoline compounds described in R. T. Kreinman, J. Imag. Sci. & Tech., 10(6), page 242 (1984), isothiazoline compounds described in Research Disclosure, Vol. 205, No. 20526 (1981, May), isothiazoline compounds described in the same, Vol. 228, No. 22845 (1983 April), and compounds described in JP-A No. 62-209532 may be used together as a microbiocide.

In addition, compounds as described in "Anti-bacterial Anti-fungal Chemistry", Hiroshi Horiguchi, Mitsui Press (1982), "Anti-bacterial, Anti-fungal Technique Handbook", The Society for Anti-bacterial and Anti-fungal Agents, Japan, Hakuhodo (1986) may be contained.

Further, a part or all of overflow from the washing bath or stabilizing bath due to replenishing water which is provided with the anti-fungal means, depending on processing, to the washing bath or stabilizing bath, may be utilized for diluting a processing solution having fixing capacity, which is a preceding step thereof, as described in JP-A No. 60-235133.

4) Processing System

Usually, industrial X-ray photosensitive materials are processed for a total processing time (Dry to Dry), from carrying in into a developing bath to completion of a drying step, of 11 minutes or shorter, and further 5 minutes or shorter in another system. For example, in the case where the total processing time is 5 minutes or shorter, it is preferable that development is conducted at 30° C. to 40° C. for 15 seconds to 75 seconds, fixation is conducted for 15 seconds to 75 seconds, washing is conducted at 0° C. to 40° C. for 15 seconds to 75 seconds, and drying is conducted at 15° C. to 75° C. for 1 seconds to 30 seconds.

The industrial X-ray photosensitive material of the invention can be rapidly processed, and may be processed for the total processing time (Dry to Dry) oft 3 minutes and 30 seconds or shorter. In the case of 3 minutes and 30 seconds or shorter, it is preferable that development is conducted at 30° C. to 40° C. for 15 seconds to 75 seconds, fixation is conducted for 15 seconds to 75 seconds, washing is conducted at 0° C. to 40° C. for 15 seconds to 75 seconds, and drying is conducted at 15° C. to 75° C. for 15 seconds to 30 seconds.

In addition, the replenishing amount has been conventionally each 3.5 mL to 650 mL of the developer, 3.5 mL to 650 mL of the fixing solution, and 30 mL to 650 mL of washing water per 1 $m^2$ of the photosensitive material. However, when the industrial X-ray photosensitive material of the present invention is used, those replenishing amounts can be reduced by half.

Details of such processing may be referred to the description of the aforementioned JP-A No. 9-329875 or the like.

In the processing system of the invention, the carry-over amount of the solution carried by the photosensitive material from the developing bath to the fixing bath, and from the fixing bath to the washing bath is preferably from 0.2 mL to 4 mL, more preferably from 0.2 mL to 2.4 mL, and even preferably from 0.4 mL to 2.0 mL, per one sheet of one quarter size.

When the washing bath is a multiple-stage type bath, the carry-over amount of washing water carried from a washing bath to the next washing bath is preferably from 0.2 mL to 4 mL, more preferably from 0.2 mL to 2.4 mL, and even more preferably from 0.21 mL to 1.6 mL, per one sheet of one quarter size.

The carry-over amount of washing water upon entrance into a drying zone from the washing bath is preferably from 0.2 mL to 4 mL, more preferably from 0.2 mL to 3 mL, and even more preferably from 0.2 mL to 2.5 mL, per one sheet of one quarter size.

(Application)

The industrial X-ray photosensitive material of the invention is used in a nondestructive inspection method for testing or analyzing a defect in a constituent part such as glass, paper, wood or metal parts. Since the nondestructive inspection method enables a welding defect, or a defect of a material tissue of an aircraft constituting part, a nuclear reactor, or a pipe line to be detected, it is widely used in aeronautics, nuclear industry and petroleum industry.

All publications, patent applications, and technical standards mentioned in this specification are herein incorporated by reference to the same extent as if each individual publication, patent application, or technical standard was specifically and individually indicated to be incorporated by reference.

EXAMPLES

In the following, the present invention will be explained by examples thereof, but the present invention is by no means limited by such examples.

Example 1

1. Preparation of Silver Halide Emulsion (Preparation of Silver Halide Emulsion A1)

<Preparation of Core (Nucleus Part)>

An aqueous solution (1178 mL) containing 0.8 g of KBr, and 1.1 g of gelatin having an average molecular weight of 20000 was stirred while a temperature of the solution was kept at 35° C. An $AgNO_3$ (2.6 g) aqueous solution and a KBr (1.7 g) aqueous solution were added by a double jet method over 135 seconds. The $AgNO_3$ aqueous used here had a concentration of $AgNO_3$ of 0.2 mol/L. Thereafter, a temperature of the mixture was raised to 68° C. over 30 minutes, and 13 g of succinated gelatin having an average molecular weight of 100000 was added.

After raising the temperature, an $AgNO_3$ (3.1 g) aqueous solution and a KBr (2.4 g) aqueous solution were added by a double jet method over 1339 seconds. The $AgNO_3$ aqueous solution used for this operation had a concentration of $AgNO_3$ of 0.2 mol/L.

<Preparation of Shell (Tabular Part)>

An $AgNO_3$ (232 g) aqueous solution and a KBr aqueous solution were added over 45 minutes while the pAg was kept at 8.0, and the flow rate was accelerated by a controlled double jet method. After gelatin having an average molecular weight of 100000 was added, desalting was conducted according to a conventional method. Thereafter, gelatin having an average molecular weight of 100000 was added, and dispersed, and the pH was adjusted to 5.8, and the pAg was adjusted to 8.0 at 40° C. to prepare an emulsion.

The obtained emulsion contained 0.73 mole of Ag, and 104 g of gelatin per 1 kg of the emulsion, and silver halide particles in the emulsion were tabular particles having an average equivalent circular diameter of 1.17 μm, a variation coefficient of the equivalent circular diameter distribution of 25%, an average thickness of 0.13 μm, and an aspect ratio of 9.0. Measurement of the particle shape was performed by observing photographic image by a transmission electron microscope of a replica of the particles.

(Preparation of Silver Halide Emulsion A2)

<Preparation of Core (Nucleus Part)>

An aqueous solution (1178 mL) containing 0.8 g of KBr, and 1.1 g of gelatin having an average molecular weight of 20000 was stirred while a temperature of the solution was kept at 35° C. An $AgNO_3$ (2.6 g) aqueous solution and a KBr (1.7 g) aqueous solution were added over 135 seconds by a double jet method. The $AgNO_3$ aqueous solution used here had a concentration of $AgNO_3$ of 0.2 mol/L. Thereafter, a temperature of the mixture was raised to 68° C. over 30 minutes, and 13 g of succinated gelatin having an average molecular weight of 100000 was added.

After raising the temperature, an $AgNO_3$ (3.1 g) aqueous solution and a KBr (2.4 g) aqueous solution were added over 1339 seconds by a double jet method. The $AgNO_3$ aqueous solution used for this operation had a concentration of $AgNO_3$ of 0.2 mol/L.

<Preparation of Shell (Tabular Part)>

An $AgNO_3$ (232 g) aqueous solution, and a KBr aqueous solution containing potassium hexachloroiridate (III) (in an amount corresponding to $1.7\times10^{-5}$ mole of iridium per 1 mole of silver) were added over 45 minutes while the pAg was kept at 8.0, and the flow rate was accelerated by a controlled double jet method. After gelatin having an average molecular weight of 100000 was added, desalting was conducted according to the conventional method. Thereafter, gelatin having an average molecular weight of 100000 was added, and dispersed, and the pH was adjusted to 5.8, and the pAg was adjusted to 8.0 at 40° C. to prepare an emulsion.

The emulsion contained 0.73 mole of Ag and 104 g of gelatin per 1 kg of the emulsion, and silver halide particles in the emulsion were tabular particles having an average equivalent circular diameter of 1.17 μm, a variation coefficient of an equivalent circular diameter distribution of 25%, an average thickness of 0.13 μm, and an aspect ratio of 9.0. The particles did not contain iridium in the core corresponding to 2.4% by volume, and contained iridium in the shell corresponding to 97.6% by volume. Measurement of the particle shape was performed by observing photographic image by a transmission electron microscope of a replica of the particles.

(Chemical Sensitization)

Each of the emulsions prepared as described above was subjected to chemical sensitization while stirring under the condition where a temperature of the emulsion was kept at 52° C. First, sodium benzenethiosulfonate was added at $7.5\times10^{-5}$ mole per 1 mole of silver halide. Then, AgI fine particles having a diameter of 0.03 μm were added at 0.15 mol % based on the total silver amount. Then, potassium thiocyanate was added at $6.5\times10^{-4}$ mole equivalent per 1 mole of silver halide, and potassium chloride was further added. Thereafter, a solution of sensitization dye 1 shown below was added at $5\times10^{-4}$ mole equivalent per 1 mole of silver halide.

Subsequently, after chloro aurate at $3.4\times10^{-5}$ mole equivalent per 1 mole of silver halide, and potassium thiocyanate at $6.5\times10^{-4}$ mole equivalent per 1 mole of silver halide were added, sodium thiosulfate at $2.6\times10^{-5}$ mole equivalent per 1 mole of silver halide, and a selenium compound-1 at $4.1\times10^{-6}$ mole equivalent per 1 mole of silver halide were added. After 100 minutes, the mixture was cooled to 35° C., and chemical sensitization of the emulsion was completed.

2. Preparation of Coating Sample

2-1. Preparation of Support

Corona discharge treatment was performed on a biaxially stretched blue-stained polyethylene terephthalate support (containing 1,4-bis(2,6-diethylanilinoanthraquinone)), having a thickness of 175 μm, and each coating solution containing the following main components was coated on both sides of the support with a wire bar coater in order of a first undercoat layer and a second undercoat layer.

First Undercoat Layer (Support Side)

An amount of the coating solution per 1 $m^2$ of one side of the support was set to be 4.9 mL. The coating amount of each component per 1 $m^2$ of one side of the support is as follows.

| | |
|---|---|
| Styrene-butadiene copolymer latex (on the basis of solid content) | 0.31 g |
| 2,4-Dichloro-6-hydroxy-s-triazine sodium salt | 8 mg |
| Drying temperature | 190° C. |

Second Undercoat Layer

An amount of the coating solution per 1 $m^2$ of one side of the support was set to be 7.9 mL. The coating amount of each component per 1 $m^2$ one side of the support is as follows.

| | |
|---|---|
| Gelatin | 80 mg |
| $C_{12}H_{25}O(CH_2CH_2O)_{10}H$ | 1.8 mg |
| Antiseptic agent (benzoisothiazolinone sodium salt) | 0.27 mg |
| Matting agent having an average particle diameter of 2.5 μm, made of polymethyl methacrylate | 2.5 mg |
| Drying temperature | 185° C. |

2-2. Preparation of Coating Samples 1 to 3

The following silver halide emulsion layer and surface protective layer were coated on both sides of the support on which the prepared undercoat layers had been coated as described above, by a simultaneous extrusion coating method, so that a construction in which a silver halide emulsion layer and a surface protective layer are disposed in this order from the support side was realized. A sample number and the content thereof are shown in Table 1.

(Coating Solution for Silver Halide Emulsion Layer)

Each additive was added to each silver halide emulsion, so that the amount of each additive became the following coating amount. The amount is indicated as the material coating amount per 1 $m^2$ one side.

| | |
|---|---|
| Silver halide emulsion (the No. thereof is shown in Table 1) (amount of coated silver) | 4.7 $g/m^2$ |
| Gelatin | 6.4 $g/m^2$ |
| 1-Phenyl-5-mercaptotetrazole | 5.0 $mg/m^2$ |
| Additive-1 | 68.4 $mg/m^2$ |
| Additive-2 | 1.6 $mg/m^2$ |
| Additive-3 | 5.32 $mg/m^2$ |
| Additive-4 | 5.1 $mg/m^2$ |
| Dye-1(bluing dye) | 3.5 $mg/m^2$ |
| Dye-2 | 0.41 $g/m^2$ |
| Hardener-1 (1,2-bis(vinylsulfonylacetamido)ethane) | (described in Table 1) |

(Coating Solution for Surface Protective Layer)

A coating solution for the surface protective layer was prepared so that the amount of each component became the following coating amount per one side, and coated. The pH was adjusted to 6.0 with NaOH.

| | |
|---|---|
| Gelatin | 1.4 $g/m^2$ |
| Poly(sodium acrylate) (average molecular weight of 400000) | 60 $mg/m^2$ |
| Copolymer of butyl acrylate/methacrylic acid (6/4 by weight ratio) | 66.9 $mg/m^2$ |
| Coating aid-1 | 15.8 $mg/m^2$ |
| Coating aid-2 | 29.5 $mg/m^2$ |
| Coating aid-3 | 7.7 $mg/m^2$ |
| Coating aid-4 | 1.4 $mg/m^2$ |
| Coating aid-5 | 3.6 $mg/m^2$ |
| Additive-5 | 2.4 $mg/m^2$ |
| Matting agent-1 (number average particle diameter of 3.8 μm) | 54.2 $mg/m^2$ |
| Proxel (benzisothiazolone) | 1.1 $mg/m^2$ |

(Measurement of Swelling Value of Coating Material)

First, a photosensitive material to be measured was allowed to stand for 7 days under the conditions of 40° C. and relative humidity of 60%. Then, after the photosensitive material was immersed in distilled water at 21° C. for 3 minutes, a film thickness was measured. A value obtained by subtracting the film thickness value in the dry state from the measured value was adopted as a swelling value.

3. Evaluation of Photographic Performance

The photographic materials were evaluated with respect to each item by the following method.

<X-Ray Sensitivity and Gradation>

Each coating material was placed into a cassette with a lead foil sensitizing paper, and X-ray irradiation was performed in a stepwise manner for such the time that the X-ray irradiation time became 1 second, 1.6 second, 2.5 second, . . . being longer by $10^{0.2}$-fold.

The exposed sample was subjected to developing processing using a developer and a fixing solution having the following composition by an automatic developing apparatus FIP4000 (manufactured by Fuji Film). The developing condition was as described below, and development was performed for 5 minutes by Dry to Dry time.

Development: 35° C., 60 seconds; fixation: 40° C., 40 seconds; washing: 40 second; stabilization: 30 seconds From the optical density of the resulting sample, a characteristic curve represented by the relationship of log (X-ray irradiation time) vs optical density was obtained. The X-ray irradiation time ($E_0$) at a point at which the optical density becomes the density of (fog+1.5), and the X-ray irradiation time ($E_1$) at a point at which the optical density becomes the density of (fog+3.5) were obtained, and relative sensitivity and gradation (G) were obtained from these values.

$$\text{Gradation } (G)=(3.5-1.5)/(\log E_1-\log E_0)$$

Similarly, direct X-ray exposure, fluorescent screen (fluorescent material: potassium tungstate) exposure, and exposure using a Co radioactive isotope as a radiation source were performed, and relative sensitivity and gradation (G) were obtained similarly.

<Rapid Processing Suitability>

The exposed coating sample using a lead foil sensitizing paper, was subjected to processing of Dry to Dry for 3 minutes and 30 seconds in which a transporting speed was increased by modifying the automatic developing apparatus. The obtained optical density of the sample was measured, and relative sensitivity and gradation (G) were obtained similarly. The developing condition was as described below.

Development: 30° C., 60 seconds; fixation: 30° C., 60 seconds; washing: 60 second; stabilization: 30 seconds <Developer Solution>

| | |
|---|---|
| Hydroquinone | 20 g |
| 1-Phenyl-3-pyrazolidinone | 0.8 g |
| Potassium bromide | 10 g |
| Potassium iodide | 0.1 g |
| Phenyl mercaptotetrazole | 0.03 g |
| Potassium thiocyanate | 2.5 g |
| Polyglycol (molecular weight of 400) | 10 mL |
| Aqueous potassium sulfite (655 g/L) | 150 mL |
| Aqueous potassium carbonate (765 g/L) | 40 mL |
| Aqueous potassium hydroxide (755 g/L) | 0.4 mL |
| Trilon B (trade name of Na4EDTA from BASF) | 4 mL |
| Turpinal 2NZ (trade name of disodium 1-hydroxy-ethyldiphosphonate from HENKEL) | 1 g |
| pH | 10.85 |
| Water | 1 L |

<Fixing Solution>

| | |
|---|---|
| Sodium thiosulfate | 200 g |
| Potassium metabisulfite | 25 g |
| pH | 4.9 to 5.2 |
| Water | 1 L |

The obtained results are shown in Table 1.

From the results shown in Table 1, the sample according to the invention shows high contrast, and exhibits preferable high contrast performance for use in the industrial X-ray photosensitive material. Particularly, with respect to Co exposure, high contrast performance is attained, which is extremely preferable for use in the industrial X-ray photosensitive material, and is not obtained by using conventional photosensitive material. Further, the sample of the invention provides an image of excellent surface uniformity, having sufficiently high image density, high contrast, and no irregularity even by 3 minutes and 30 seconds processing. On the other hand, in the comparative sample 1, the contrast is lowered when it is processed by the rapid processing. In the comparative sample 2, when it is processed by the rapid processing, development and fixation are both incomplete, sufficient image density is not obtained, unfixed silver halide remains, and haze is high, and thus, the image of the sample is not worth assessment as an image.

Conventionally, in order to maintain high contrast, industrial photosensitive materials required a large amount of the coated silver, and it was essential to make the coated layer soft to design high contrast. In the invention, by using tabular particles doped with Ir, a low amount of coated silver is needed, and high contrast performance is attained even by hardened layer design, and rapid processing suitability for 3 minutes and 30 seconds processing which was conventionally impossible is also realized.

Further, when the coating sample of the invention is continuously processed under the 3 minutes and 30 seconds processing condition, replenishing amounts of the developer solution and the fixing solution are each about ½ amount of that in 5 minutes processing, and stable performance is obtained.

TABLE 1

| Sample No. | Silver halide emulsion No. | Addition amount of Hardener-1 (mg/m²) | Swelling value (mm) | Relative sensitivity (S) Direct | Lead foil | Co | Fluorescent screen | Contrast (G) Direct | Lead foil | Co | Fluorescent screen | Rapid processing suitability S | G | Remark |
|---|---|---|---|---|---|---|---|---|---|---|---|---|---|---|
| 1 | A1 | 150 | 12 | 100 | 100 | 100 | 100 | 4.40 | 4.40 | 5.41 | 5.90 | 100 | 3.8 | Comparative |
| 2 | A1 | 60 | 24 | 120 | 120 | 120 | 120 | 4.40 | 4.40 | 5.41 | 5.90 | ′ | ′ | Comparative |
| 3 | A2 | 150 | 12 | 100 | 100 | 100 | 100 | 4.71 | 4.75 | 5.8 | 6.52 | 100 | 4.5 | Invention |

Example 2

1. Preparation of Silver Halide Emulsion A3

Silver halide emulsion A3 was prepared in a similar manner to that in the preparation of silver halide emulsion A2, except that a Rh compound (ammonium hexachlororhodate (III)) was added at $1.7\times10^{-5}$ mole per 1 mole of silver in place of potassium hexachloroiridate (III) in the preparation of silver halide emulsion A2 of Example 1, and was chemically sensitized similarly.

2. Preparation of Coating Sample 4 and Evaluation of Performance

Using the obtained silver halide emulsion A3, a coating sample was prepared in a similar manner to that in the preparation of coating sample 3 of Example 1. The swelling value (thickness) was 12 μm. Performance was evaluated in a similar manner to that in Example 1. As a result, the sample of the invention exhibits excellent performance similar to Example 1.

Example 3

1. Preparation of Silver Halide Emulsion A4

Silver halide emulsion A4 was prepared in a similar manner to that in the preparation of silver halide emulsion A2, except that potassium hexachloroiridate (III) was added at $1.7\times10^{-5}$ mole per 1 mole of silver in a step of preparing a core in the preparation of silver halide emulsion A2 of Example 1, and chemically sensitized similarly.

That is, silver halide emulsion A4 is a comparative silver halide emulsion containing iridium in a core and a shell.

2. Preparation of Silver Halide Emulsion A5 to A6

The ratio by volume of a core to a shell was exchanged in the preparation of silver halide emulsion A2 of Example 1, and silver halide emulsions A5 (the invention) and A6 (comparative) were prepared. The ratio by volume of a core to a shell was adjusted so that an objective ratio was obtained by changing each preparation total amount according to the formulation shown in the preparation of a core and the formulation shown in the preparation of a shell in Example 1, and the sample was chemically sensitized similarly.

Silver halide emulsion A5: core of 2.4% by volume, shell of 97.6% by volume

Silver halide emulsion A6: core of 4.0% by volume, shell of 96.0% by volume

3. Preparation of Coating Samples 10 to 12

Using the obtained silver halide emulsions A4 to A6, coating samples 10 to 12 were prepared in a similar manner to that in the preparation of coating sample 3 of Example 1.

4. Performance Evaluation

Each of the samples 10 to 12 had the swelling value (thickness) of 12 μm.

Evaluation was performed in a similar manner to that in Example 1 and the obtained results are shown in Table 2.

Sample 11 of the invention exhibits excellent performance similar to that of sample 3 in Example 1.

On the other hand, comparative sample 10 had showed sensitivity lower by 15% than that of the invention. In addition, comparative sample 12 had showed sensitivity lower by 25% than that of the invention.

Chemical structures of the compounds used in Examples of the invention are shown below.

Sensitizing Dye-1

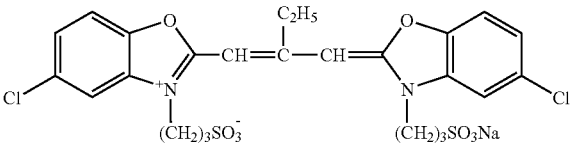

Selenium Compound-1

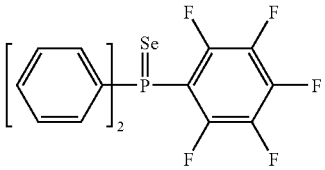

Additive-1

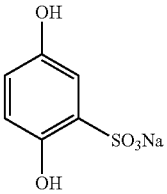

Additive-2

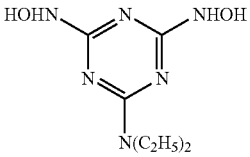

Additive-3

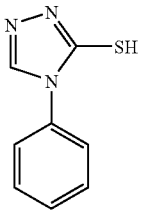

-continued

Additive-4

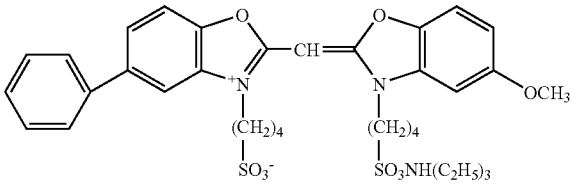

Dye-1

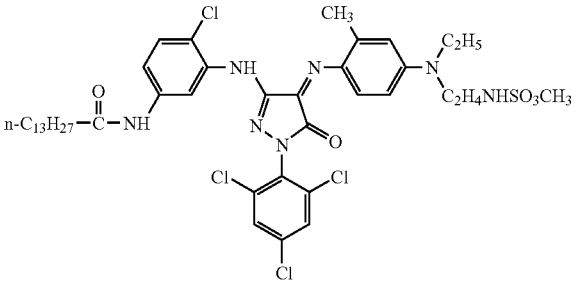

Dye-2

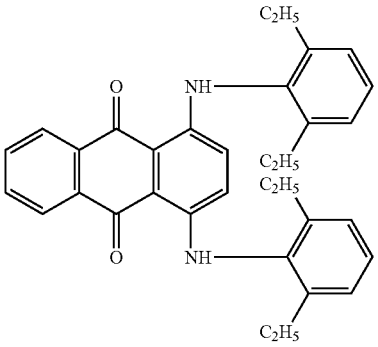

-continued

Coating Aid-1

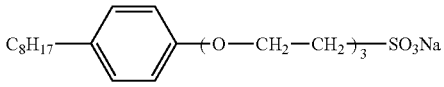

Coating Aid-2

Coating Aid-3

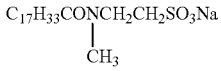

Coating Aid-4

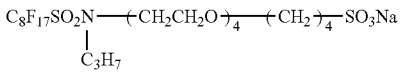

Coating Aid-5

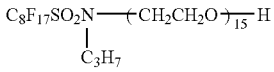

Additive-5

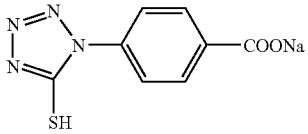

Matting Agent-1

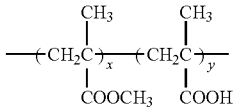

(X/Y = 95/5 by weight %)

TABLE 2

| Sample No. | Silver halide emulsion No. | Core | Shell | Relative sensitivity (S) Direct | Lead foil | Co | Fluorescent screen |
|---|---|---|---|---|---|---|---|
| 10 | A4 | 2.4% by volume (containing Ir) | 97.6% by volume (containing Ir) | 85 | 85 | 85 | 85 |
| 11 | A5 | 2.4% by volume (No Ir) | 97.6% by volume (containing Ir) | 100 | 100 | 100 | 100 |
| 12 | A6 | 4.0% by volume (No Ir) | 96.0% by volume (containing Ir) | 75 | 75 | 75 | 75 |

| Sample No. | Contrast (G) Direct | Lead foil | Co | Fluorescent screen | Rapid processing suitability S | G | Remark |
|---|---|---|---|---|---|---|---|
| 10 | 4.80 | 4.85 | 5.85 | 6.52 | 85 | 4.5 | Comparative |
| 11 | 4.71 | 4.75 | 5.80 | 6.52 | 100 | 4.5 | Invention |
| 12 | 4.71 | 4.75 | 5.80 | 6.52 | 75 | 4.5 | Comparative |

What is claimed is:

1. An industrial X-ray photosensitive material comprising at least one silver halide emulsion layer on both sides of a transparent support, wherein the silver halide emulsion layer contains tabular silver halide particles having an average particle thickness of from 0.03 μm to 0.15 μm and an aspect ratio of more than 8, a core of the particles which is a core having a volume of 1% or more and less than 3% of a particle volume does not contain Ir or Rh, and a shell of the particles which is a shell having a volume of 97% or more and less than 99% of a particle volume contains at least Ir or Rh.

2. The industrial X-ray photosensitive material according to claim 1, wherein the shell contains Ir or Rh in an amount of from $1\times10^{-9}$ mol % to $1\times10^{-2}$ mol % per 1 mole of silver.

3. The industrial X-ray photosensitive material according to claim 1, wherein a water swelling value per one side of the industrial X-ray photosensitive material is less than 20 μm.

4. The industrial X-ray photosensitive material according to claim 1, wherein an amount of coated silver per one side of the industrial X-ray photosensitive material is less than 5.5 $g/m^2$.

5. The industrial X-ray photosensitive material according to claim 1, wherein a ratio by weight of a total amount of coated gelatin to an amount of coated silver per one side of the industrial X-ray photosensitive material (total amount of coated gelatin/amount of coated silver) is from 1.4 to 1.8.

6. The industrial X-ray photosensitive material according to claim 2, wherein a water swelling value per one side of the industrial X-ray photosensitive material is less than 20 μm.

7. The industrial X-ray photosensitive material according to claim 2, wherein an amount of coated silver per one side of the industrial X-ray photosensitive material is less than 5.5 $g/m^2$.

8. The industrial X-ray photosensitive material according to claim 2, wherein a ratio by weight of a total amount of coated gelatin to an amount of coated silver per one side of the industrial X-ray photosensitive material (total amount of coated gelatin/amount of coated silver) is from 1.4 to 1.8.

9. The industrial X-ray photosensitive material according to claim 1, wherein a total processing time (Dry to Dry) is 3 minutes and 30 seconds or shorter.

10. The industrial X-ray photosensitive material according to claim 1, wherein the aspect ratio of tabular silver halide particles is from 9 to 16.

* * * * *